United States Patent [19]

Honma et al.

[11] 4,389,126

[45] Jun. 21, 1983

[54] SERIAL IMPACT PRINTER HAVING TWO PRINTING MODES

[75] Inventors: Yoshikiyo Honma; Jun Shimogawara; Muneyoshi Nagata; Yukihiko Oka; Yukiaki Koyanagi; Yukiyoshi Hosoya; Takashi Hada, all of Tokyo, Japan

[73] Assignee: Nippon Electric Co., Ltd., Tokyo, Japan

[21] Appl. No.: 278,033

[22] Filed: Jun. 29, 1981

[30] Foreign Application Priority Data

| | | | |
|---|---|---|---|
| Jun. 27, 1980 | [JP] | Japan | 55-87427 |
| Jun. 27, 1980 | [JP] | Japan | 55-87428 |
| Jun. 27, 1980 | [JP] | Japan | 55-87429 |
| Jun. 27, 1980 | [JP] | Japan | 55-87430 |
| Jun. 27, 1980 | [JP] | Japan | 55-87431 |
| Jun. 27, 1980 | [JP] | Japan | 55-87432 |
| Jun. 27, 1980 | [JP] | Japan | 55-87433 |
| Jun. 27, 1980 | [JP] | Japan | 55-87434 |
| Jun. 27, 1980 | [JP] | Japan | 55-87435 |

[51] Int. Cl.[3] ..... B41J 3/54; B41J 1/50; B41J 3/50

[52] U.S. Cl. ..... 400/82; 101/93.05; 101/93.12; 400/124; 400/149; 400/144.1

[58] Field of Search ..... 400/82, 149, 150, 124, 400/144.1-144.3; 101/93.05, 93.12, 93.17

[56] References Cited

U.S. PATENT DOCUMENTS

| | | | |
|---|---|---|---|
| 4,197,022 | 4/1980 | Dollenmayer | 400/149 X |
| 4,204,779 | 5/1980 | Lee et al. | 400/82 X |

FOREIGN PATENT DOCUMENTS

| | | | |
|---|---|---|---|
| 33226 | 8/1981 | European Pat. Off. | 400/144.1 |
| 2232590 | 1/1974 | Fed. Rep. of Germany | 400/124 |
| 2856713 | 7/1979 | Fed. Rep. of Germany | 400/144.1 |
| 141137 | 4/1980 | Fed. Rep. of Germany | 400/124 |
| 55-41213 | 3/1980 | Japan | 400/144.1 |

OTHER PUBLICATIONS

*IBM Tech. Disc. Bulletin,* by J. M. Dunn, vol. 22, No. 10, Mar. 1980, pp. 4364-4365.

*Primary Examiner*—Paul T. Sewell

*Attorney, Agent, or Firm*—Sughrue, Mion, Zinn, Macpeak and Seas

[57] ABSTRACT

A serial impact printer has two printing modes, one being a formed-character mode and the other a dot matrix mode. A plurality of dot matrix wires are disposed behind a character carrying member having characters on fingers. One of the wires impacts a selected finger in the formed-character mode. In the dot matrix mode, however, printing is performed by directly contacting a paper with selected ones of said dot matrix wires.

9 Claims, 21 Drawing Figures

| CHARACTER TO BE PRINTED | WIRES TO BE ACTUATED |
|---|---|
| M.W. @ | a.b.c.d.e.f.g |
| B.D.E.G.H.K.N.O.P. Q<br>R.X<br>g.m.w. $.&.%.#<br>8 | a. b.c. e.f.g |
| A.C.F. J.L.S.T.U.V.<br>Y.Z. a.b.d.e.f.h.k<br>n.o.p.q.s.u.x.y.z<br>2.3.4.5.6.7.0Ø | a. c. e. g |
| [<br>c.i.j.ℓ.r.t.v<br>!.;.?.(.).[].{}.|./.\ | a. d. g |
| :."."!.+.=.¬.* | a. d. g |
| ..,¯.–.'.`.^.~ | a g |

SERIAL IMPACT PRINTER HAVING TWO PRINTING MODES

BACKGROUND OF THE INVENTION

1. Field of the Invention

This invention relates to a serial impact printer, and more particularly to a serial impact printer having two printing modes.

2. Description of the Prior Art

Impact printers are useful in multiple copy capability and flexibility of print receiving paper compared with non-impact printers such as ink-jet printers and thermal printers. Impact printers are classified by printing mode into two types, one being a formed-character printing type for printing fully formed characters on the print receiving paper on a platen, and the other being a dot-matrix type for impacting the print receiving paper on the platen by selected ones of a plurality of wires. These types of impact printers have different features in use. The formed-character printing type is excellent in print quality compared with the dot matrix type, while the latter is advantageous in printing speed. Therefore, these types of impact printers are separately used in accordance with printing purposes. This requires at least two impact printers in order to respond to all kinds of printing requirements.

For this purpose, there has been proposed, as disclosed in the Japanese Patent Disclosure No. 54-156725, a multi-head serial printer in which two types of printing heads, i.e., a formed-character printing head and a dot matrix printing head, are mounted on a single carriage, and one of the two printing heads is selectively used for printing in accordance with the printing purpose. In the multi-head serial printer, because the two printing-heads are mounted at different positions on the carriage, printing strokes for such printing heads are apart from each other by a distance equal to an interval between the two printing heads. This means that the two printing heads have different left or right margins. Further, two printing heads on the single carriage make the carriage massive, whereby a complicated position-control circuit is required for positioning the massive carriage at a commanded position.

SUMMARY OF THE INVENTION

It is, therefore, an object of this invention to provide a serial impact printer having two printing modes and a simplified printing-carriage mechanism.

It is another object of this invention to provide a serial impact printer, in which the printing operations in accordance with two printing modes can be selectively performed by means of a single printing head.

According to this invention, there is provided a serial impact printer for serially printing on a paper and comprising: a carriage for sliding along said paper; a character carrying member rotatably mounted to said carriage and having a plurality of fingers, at least one formed-character being disposed on said finger; a plurality of wires mounted on said carriage and behind said character carrying member with respect to said paper; and actuator means for actuating said plurality of wires. In a formed-character printing mode, printing is achieved by impacting a selected character on the character carrying member by means of at least one of the plurality of wires. In a dot-matrix printing mode, the printing is performed by directly impacting the paper by means of selected ones of the plurality of wires.

The above and other features and advantages of this invention will be apparent from the following description of preferred embodiments of this invention taken in conjunction with the accompanying drawings, wherein.

DESCRIPTION OF THE PREFERRED EMBODIMENTS

Figure 1:
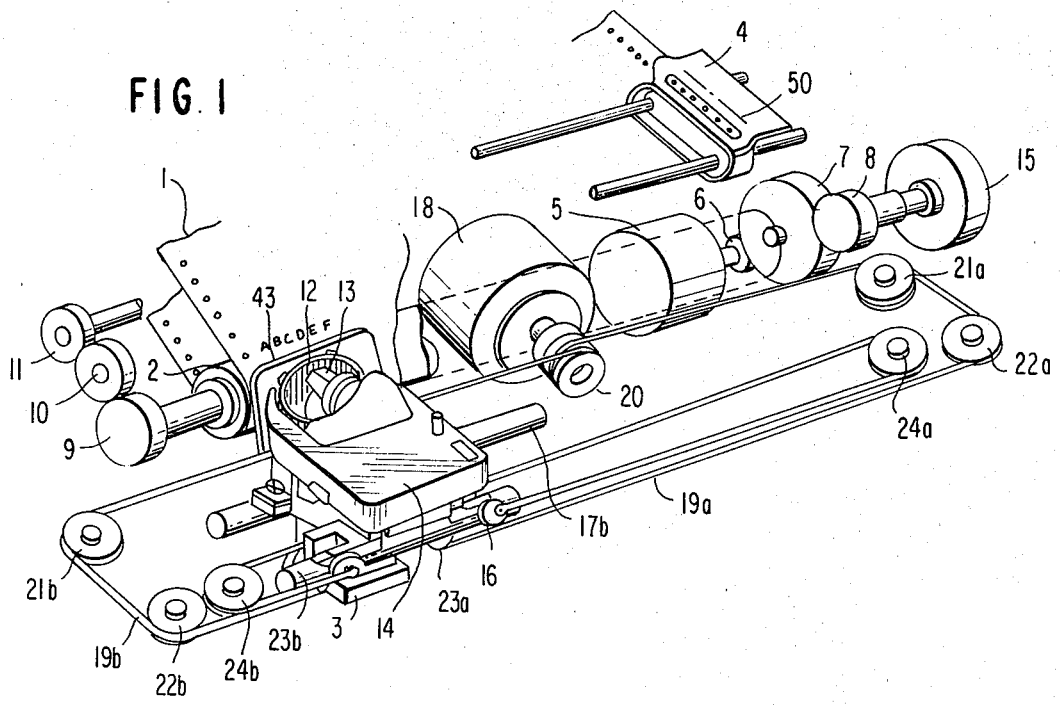
FIG. 1 is a perspective view of a first embodiment of this invention.

Referring to FIG. 1, the first embodiment comprises a platen 2 on which a print receiving member (paper) 1 is to be laid, a carriage 3 for sliding along the platen 2, and a tractor unit 4 for feeding the paper 1. The platen 2 is driven by a pulse motor 5 through a motor gear 6 coupled directly to the pulse motor 5, and an idle gear 7 and a platen gear 8 coupled directly to the platen 2. The platen 2 may be manually driven by means of a knob 15.

The tractor unit 4 is driven in synchronism with a rotation of the platen 2. The rotational power of the platen 2 is transmitted from a platen gear 9 coupled directly to the platen 2 through an idle gear 10 to a tractor gear 11 which is coupled directly to the tractor unit 4. The tractor unit 4 feeds the paper 1 by means of tractor pins 50 by a predetermined interval.

The carriage 3 includes a print thimble 12, a dot-matrix print head 13 having a plurality of wires 53 (FIG. 4), and an inked ribbon cartridge 14. The carriage 3 is supported on guide shafts 17*a* and 17*b* by means of a guide bearing 16. The carriage 3 is driven to slide along the platen 2 by a spacing motor 18 through two cables 19 (19*a* and 19*b*). The motor 18 has a shaft with a driving pulley 20 mounted on one end of the shaft with a number of grooves in it for driving the cables 19 which are coupled to the carriage 3 through guide pulleys 21 (21*a* and 21*b*) and 22 (22*a* and 22*b*) mounted on a frame, guide pulleys 23 (23*a* and 23*b*) mounted on the carriage 3, and guide pulleys 24 (24*a* and 24*b*) mounted to the frame.

Figure 2:
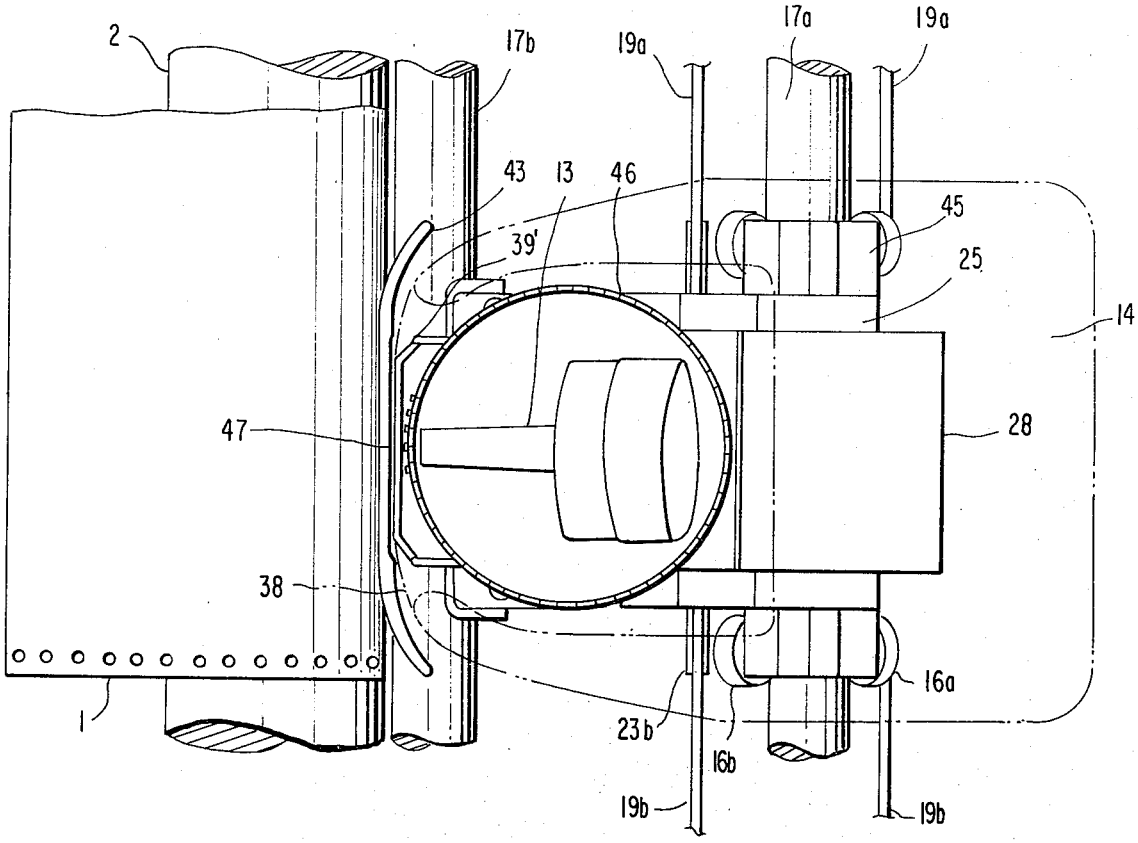
FIG. 2 is a plan view of a carriage in the first embodiment.
Figure 3:
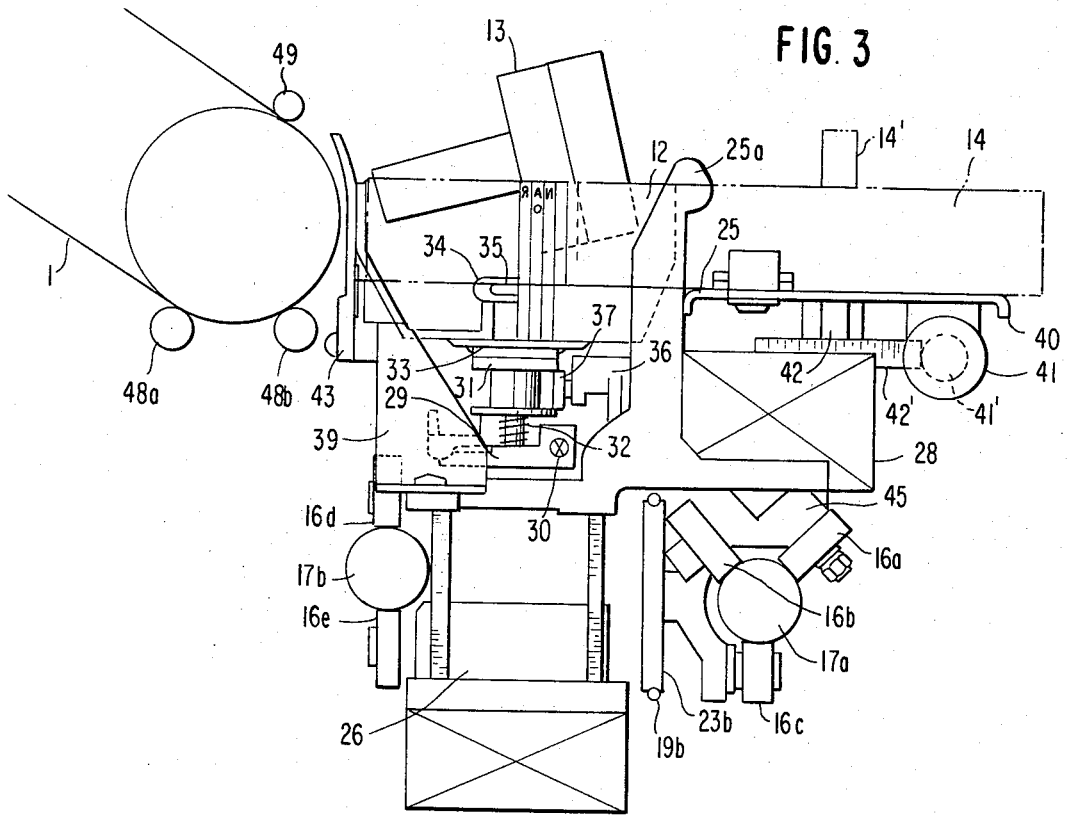
FIG. 3 is a side view of the carriage in the first embodiment.

Referring to FIGS. 2 and 3, the carriage 3 comprises a front casting 25 on which various mechanisms are mounted. There is provided on the front casting 25 a motor 26 for rotating the print thimble 12, and a motor 28 for moving vertically the print thimble 12 to select one of the characters on a finger of the print thimble 12. For character selection, a torque piece 29 is coupled to a shaft of the motor 26 by a screw 30. A vertical slide sleeve 31 coupled to the torque piece 29 is slidable vertically on the shaft of the motor 26. A spring 32 pushes up the print thimble 12 with respect to the torque piece 29. On the vertical slide sleeve 31 is provided a torque disc 33. On a pin 35 provided on a shaft of the torque disc 33, a lock piece 34 is installed for securing the print thimble 12 thereto. The vertical slide sleeve 31 has a groove to which a roller 37 provided on a drive cam follower 36 is coupled. The drive cam follower 36 is coupled to the motor 28 so that the vertical slide sleeve 31 may be positioned at any vertical position in response to a rotational angle of the motor 28.

On the front casting 25 is provided a card holder bracket 39 on which a card holder 43 is mounted. The holder 43 serves to keep the paper 1 in contact with the platen 2. Further, on the bracket 39, an arm member 39′ is mounted for guiding an inked ribbon 38 pulled out of the cartridge 14.

An inked-ribbon base 40 is provided on a bracket (not shown) secured to the front casting 25. The inked ribbon cartridge 14 is changeably supported on the base 40. A ribbon feed motor 41 is mounted on the base 40. The inked ribbon 38 in the cartridge 14 is fed by the motor 41 through a worm 41′, coupled to the rotational shaft of the motor 41, and a worm gear 42′ coupled to a torque shaft 42 which is coupled to a feed shaft 14′ of the cartridge 14.

On the front casting 25 is provided a guide casting 45, on which guide bearings 16*a*, 16*b* and 16*c* are slantly mounted so as to slide on a guide shaft 17*a*. Similarly, guide bearings 16*d* and 16*e* are provided on the front casting 25 with being slidably supported on a guide shaft 17*b*.

The print thimble 12 includes a number of fingers 46, on each of which two formed characters 47 are disposed. The print thimble 12 has a center hole into which the shaft of the torque disc 33 is inserted and secured to the thimble by the lock piece 34. The print thimble 12 may be removed by unlocking the lock piece 34.

The dot-matrix head 13 is provided behind the finger 46 with respect to the platen 2, i.e., within an area surrounded by the fingers 46 of the print thimble 12 so as to impact the selected character on the finger 46 by at least one of the wires 53 in the formed-character printing mode. In other words, the dot-matrix head 13 is used not only as the dot-matrix printing head itself in the dot-matrix printing mode, but also as hammer means for impacting the backside of the selected character on the finger 46 in the formed-character printing mode.

Figure 4:
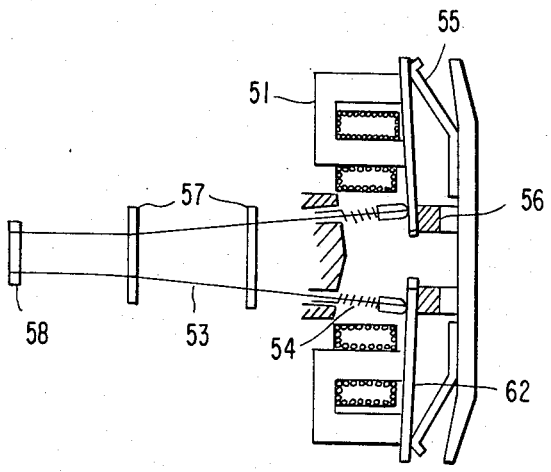
FIG. 4 is a cross-sectional view of a dot-matrix head mounted on the carriage in the first embodiment.
Figures 11, 12:
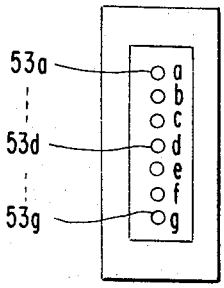
FIG. 11 shows an arrangement of the end portions of the wires of the dot-matrix head.
FIG. 12 shows the relationship between the character to be printed and the selected wires.

Referring to FIG. 4, in the dot-matrix head 13, when the electromagnet 51 is actuated, an armature 52 is pulled to thereby move out a wire 53 contacting with the armature 52 towards the platen 2. When the actuation is removed, the wire 53 is returned to the home position by means of a wire reset spring 54 and an armature reset spring 55. Although the dot-matrix head shown in FIG. 4 has only two sets of wire assemblies each including the wire 53, the magnet 51, the armature 52, the wire reset spring 54, and the armature reset spring 55, the practical dot-matrix head has larger number of wire assemblies, e.g., seven assemblies with the ends of the wires being linearly arranged as shown in FIG. 11.

In the formed-character printing mode, for character selection, the print thimble 12 is mechanically moved in both rotational and vertical directions by the motors 26 and 28, respectively. After the completion of the character selection, the dot-matrix head 13 is actuated to impact the selected character by a plurality of wires 53, whereby the selected character is impacted through the inked ribbon 38 and the paper 1 to the platen 2 for printing the selected character on the paper 1.

In the dot-matrix printing mode, the print thimble 12 is removed by locking off the lock piece 34. A plurality of wire assemblies are actuated in accordance with a command signal representing a character, a letter, a symbol, or a graphic pattern as in a conventional dot-matrix printer, whereby the ink in the ribbon 38 is printed in a dotted form on the paper 1. The dotted printing is repeated while the carriage 3 is being slid by the motor 18 and/or the paper 1 being fed by the tractor unit 4.

Figure 5A:
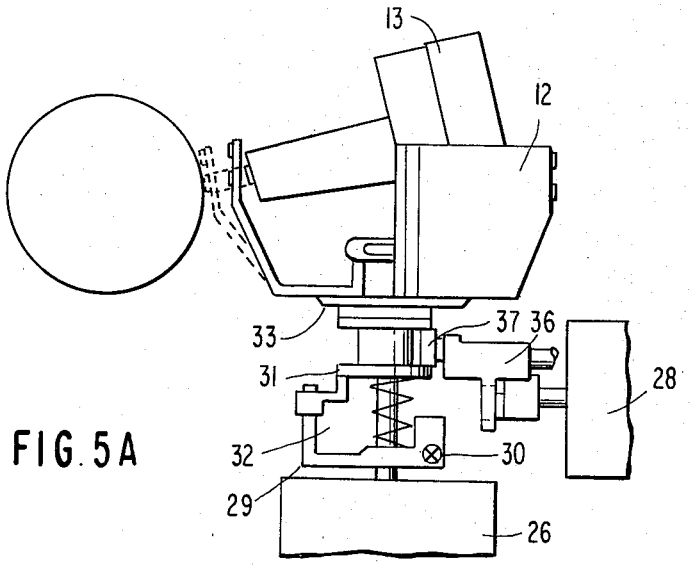
FIGS. 5A, 5B and 5C are side views of the positional relationship between the print thimble and the dot-matrix head in a second embodiment of this invention.
Figure 5B:
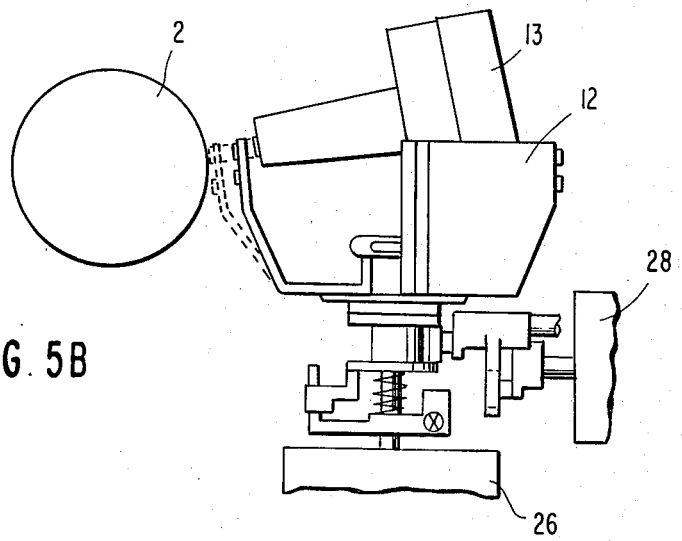
Figure 5C:
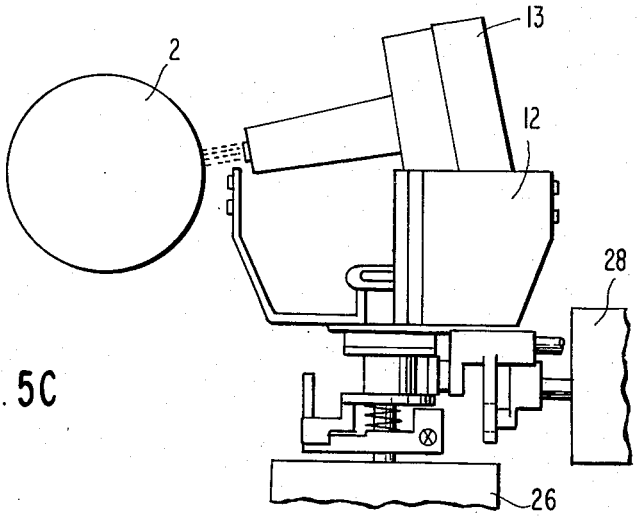

Referring to FIG. 5, in the second embodiment, the print thimble 12 is moved in the vertical direction and can be positioned at three steps, i.e., at an upper position, a middle position, and a lower position, as shown in FIGS. 5A, 5B, and 5C, respectively, in accordance with the rotational angle of the motor 28.

In the formed-character printing mode, for character selection on each finger 46, the upper or middle position is selected by rotating the motor 28. In the case where the lower character on the finger 46 is to be printed, the vertical slide sleeve 31 is positioned at an upper position, i.e., the print thimble 12 is set at the upper position as shown in FIG. 5A. When the upper character on the finger 46 is to be printed, the sleeve 31 is displaced to a middle position, i.e., the print thimble 12 is positioned at the middle position as shown in FIG. 5B.

In the dot-matrix printing mode, the vertical slide sleeve 31 is displaced to a lower position so that the selected wires of the head 13 do not impact the finger 46 of the print thimble 12, but can impact directly to the paper 1 on the platen 2 when the selected wire assemblies are actuated in accordance with the command signal. As a result, the dot-matrix printing can be achieved as in the conventional dot-matrix printer.

Figure 6:
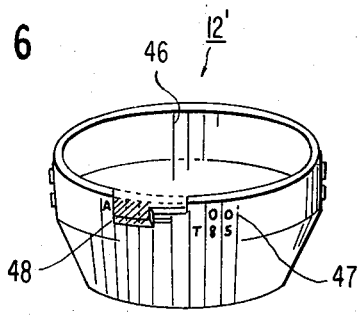
FIG. 6 is a perspective view of the print thimble in a third embodiment of this invention.

Referring to FIG. 6, the print thimble 12′ used in the third embodiment has a cut-off portion 48, in which the end portions of the fingers 46 are cut off. Therefore, each of the fingers 46 in the cut-off portion 48 has one formed-character thereon.

In the third embodiment, the formed-character printing is achieved as in the conventional printer except that the wires in the dot-matrix head 13 are used instead of the hammer means. In the dot-matrix printing mode, the motor 26 is controlled so that the cut-off portion 48 is positioned at a position faced with the platen 2. As a result, the selected wires of the head 13 do not impact the finger 46, but can impact directly to the paper 1 on the platen 2 through the cut-off portion 48 when the selected wire assemblies are actuated. The dot-matrix printing is continued as in the conventional dot-matrix printer.

Figure 7:
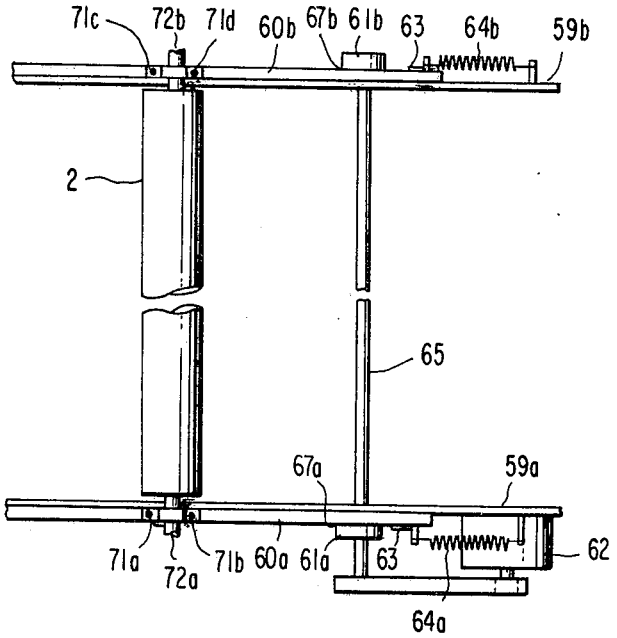
FIG. 7 is a plan view of distance adjusting means used in a fourth embodiment of this invention.
Figure 8:
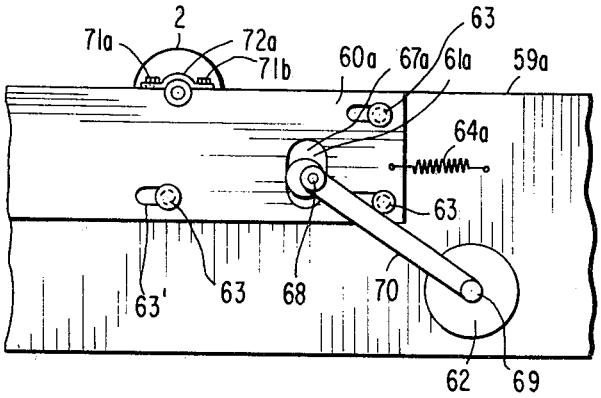
FIG. 8 is a side view of the distance adjusting means shown in FIG. 7.

Referring to FIGS. 7 and 8, the fourth embodiment further comprises LF frame means 60*a*, 60*b* installed on both side frames 59*a*, 59*b* of the printer for changing the distance between the platen 2 installed thereon and the carriage 3. The LF frames 60*a* and 60*b* are slidably supported on guide pins 63 by inserting the pins 63 into elongated holes 63'. Eccentric blocks 61*a* and 61*b* are secured to the shaft 65 rotatably supported on the side frames 59*a* and 59*b* and inserted into guide holes 67*a* and 67*b* of the LF frames. The gear 68 secured to the shaft 65 is coupled to the motor gear 69 by means of the belt 70, whereby the positions of the LF frames 60*a* and 60*b* are changeable by rotating the eccentric blocks 61*a* and 61*b* by means of a pulse motor 62. Springs 64*a* and 64*b* are used for preventing the loosening between the guide holes 67*a* and 67*b* and the eccentric blocks 61*a* and 61*b*. The platen 2 is secured to clamp plates 72*a* and 72*b* mounted on the LF frames 60*a* and 60*b* by screws 71*a* and 71*b*.

The distance between the platen 2, i.e., the paper 1 and the carriage 3 is adjusted in response to the printing mode by moving the LF frames 60, on which the platen 2 is mounted, by the pulse motor 62. In the formed-character printing mode, the distance is greater than in the dot-matrix printing mode by a value substantially equal to the thickness of the finger 46 of the print thimble 12.

Figure 9:
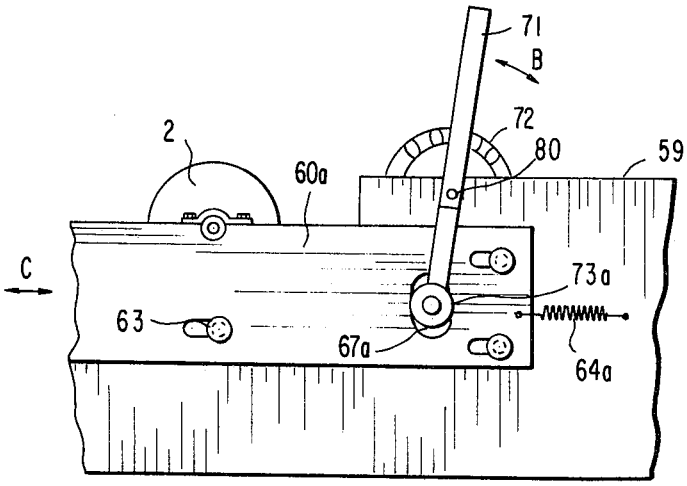
FIG. 9 is a side view of another example of distance adjusting means shown in FIG. 7.

The adjustment of the distance between the platen 2 (i.e., the paper 1) and the carriage 3 may be manually performed, as shown in FIG. 9, by moving a lever 71 pivotted around an axis 80 and contacting with a spring detent 72.

Figure 10A:
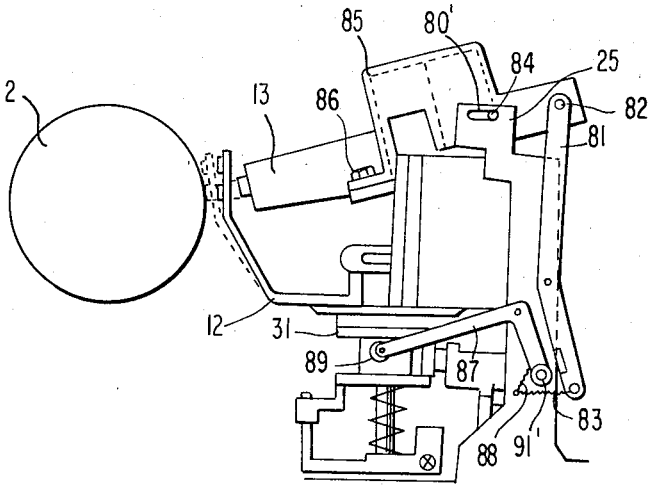
FIGS. 10A and 10B are side views of a printer head in a fifth embodiment of this invention.

Referring to FIG. 10, in the fifth embodiment, the print thimble 12 is moved in the vertical direction as in the second embodiment shown in FIG. 5. Further, the dot-matrix head 13 is moved in the lateral direction for adjusting the distance from the platen 2 in response to the printing mode.

Figure 10B:
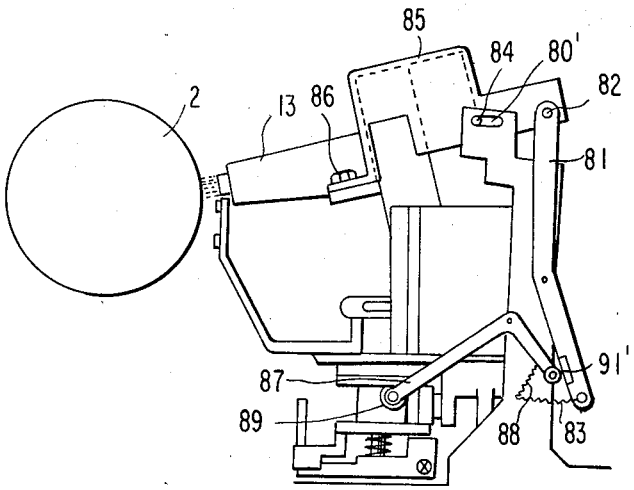

The dot-matrix head 13 is secured to a head holder 85 by screws 86. Guide pins 84 and support pins 82 are provided on both sides of the holder 85. The guide pins 84 are inserted in elongated holes 80' on the front casting 25. The support pins 82 are rotatably coupled to one ends of guide hole of arms 81 pivotted in the axis of the front casting 25. The distance between the platen 2 and head 13 can be changed by moving the arms 81. Arm springs 83 apply power to the arms 81 in a direction so as to keep away the head 13 from the platen 2. Levers 87 are rotatably supported to the front casting 25 with one ends being coupled to the vertical slide sleeve 31 through bearings 89 and the other ends having bearings 91'. The bearings 91' push on the lower portions of the lever 81 to shift the head 13 to the platen 2, when the sleeve 31 is positioned at the lower position in the dot-matrix printing mode, as shown in FIG. 10B.

In the formed-character printing mode, the number of the wires to be actuated may depend upon the character to be printed. In other words, the number of the wires to be actuated is changed in response to surface dimensions of the characters to be printed so as to keep the print pressure on the paper substantially constant. In case where the end portions 53*a* to 53*g* of the wires impacting the backside of the selected character are linearly arranged as shown in FIG. 11, the wires are selected in response to the character to be printed, i.e., with the relationship shown in a table of FIG. 12.

Figure 13:
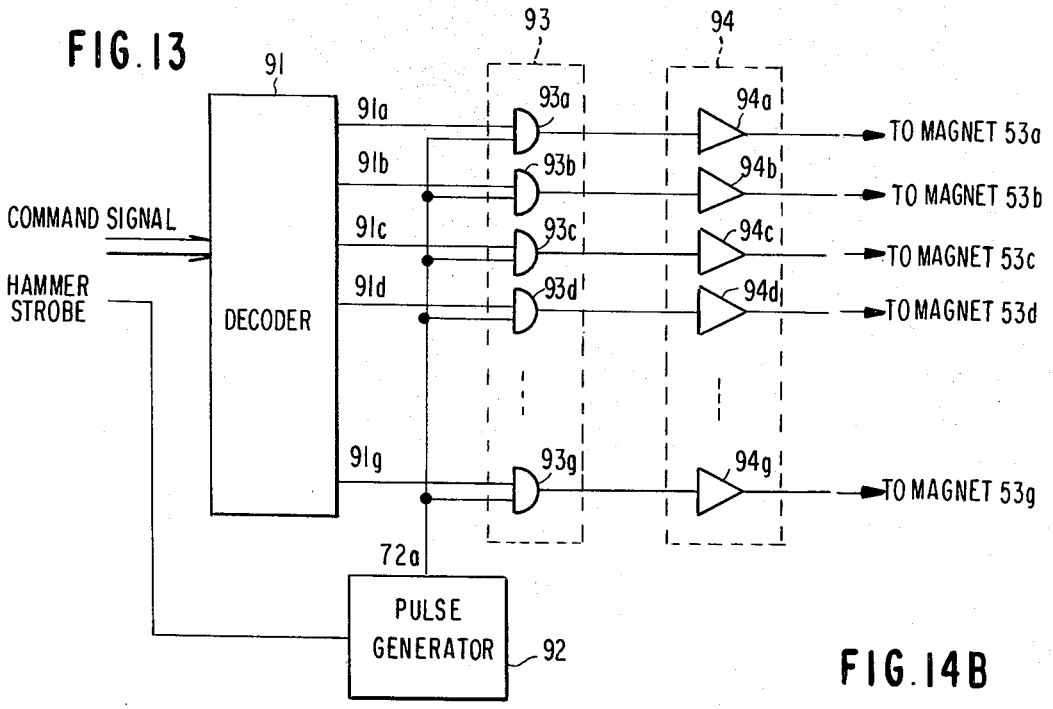
FIG. 13 is a block diagram of wire selection circuit.

Referring to FIG. 13, the wire selection circuit comprises a character decoder 91 for producing pulses at output lines in accordance with the table of FIG. 12, a pulse generator 92 receiving a hammer strobe pulse, AND gates 93 for AND-gating the pulses from the decoder circuit 91 with the pulse generator 92, and amplifiers 94. The outputs from the amplifiers 94 are supplied to the corresponding electromagnets 53*a* to 53*g*, whereby the selected wire assemblies in accordance with the table of FIG. 12 are actuated.

Figure 14A:
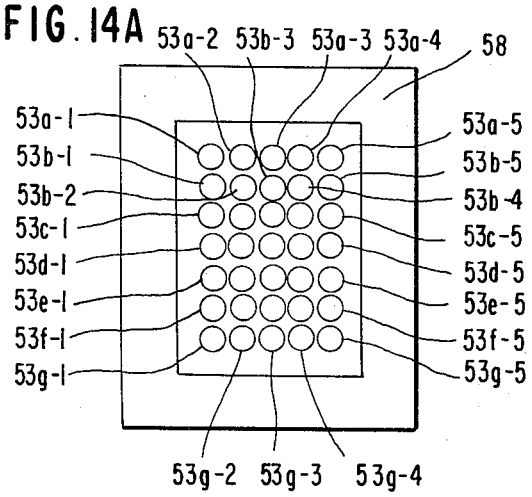
FIG. 14A, 14B and 14C show arrangements of the end portions of another example of the dot-matrix head.
Figure 14B:
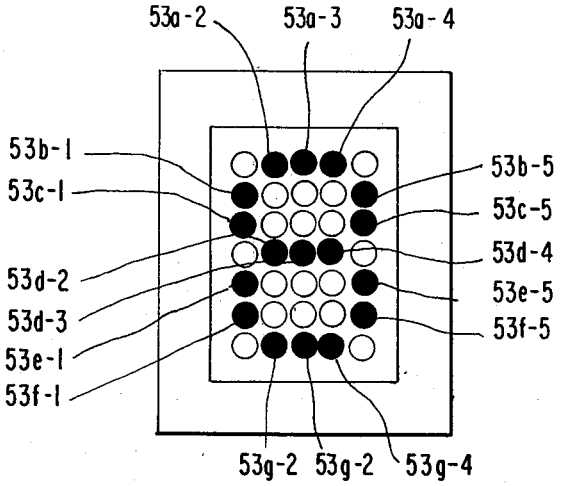
Figure 14C:
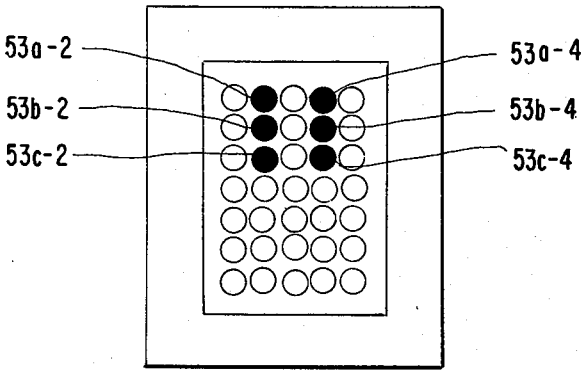

In case where the dot-matrix head 13 includes 35 (5×7) wire assemblies and the end portions $53_{a\text{-}1}$ to $53_{a\text{-}5}$, $53_{b\text{-}1}$ to $53_{b\text{-}5}$, . . . $53_{g\text{-}1}$ to $53_{g\text{-}5}$ are arranged as shown in FIG. 14A, the wires to be actuated in the formed-character printing mode may be selected in accordance with a shape of the character to be printed. For example, when the numeral "8" is to be printed in the formed-character printing mode, the wires shown by black circles in FIG. 14B are selected. Further, in case of printing the symbol ", the wires shown by black circles in FIG. 14C are selected.

Figure 15A:
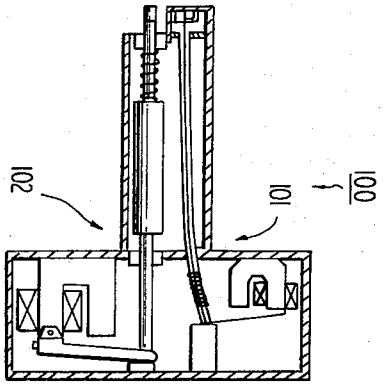
FIGS. 15A and 15B show a modification of the dot-matrix head.
Figure 15B:
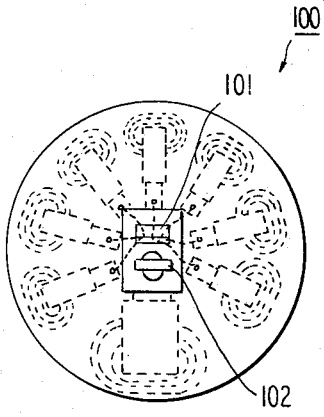

In the above-mentioned embodiments, the wires of the dot-matrix head are used as hammer means impacting the selected character in the formed-character printing mode. It may be replaced by a composite head 100, as shown in FIG. 15, having a plurality of wires 101 for printing in the dot-matrix printing mode and a hammer 102 for impacting the selected character in the formed-character printing mode.

The petal-type print thimble 12 used as character carrying means in the above embodiments may be replaced by a daisy wheel having a number of fingers arranged radially.

What is claimed is:

1. A serial impact printer for serially printing on a print receiving member comprising:

a carriage for sliding along said print receiving member;

a character carrying member rotatably mounted to said carriage and having a plurality of fingers, at least one formed-character being disposed on each of said fingers;

a plurality of wires mounted on said carriage and behind said character carrying member with respect to said print receiving member; and means for actuating said plurality of wires, a formed-character printing being achieved by impacting a selected character on said character carrying member by means of at least one of said plurality of wires and a dot-matrix printing being achieved by directly impacting said print receiving member by means of selected ones of said plurality of wires.

2. A serial impact printer as claimed in claim 1, further comprising means for removing said character carrying member.

3. A serial impact printer as claimed in claim 1, further comprising means for displacing said character carrying member to a position so that said wires do not impact said fingers of said character carrying member.

4. A serial impact printer as claimed in claim 1, wherein said character carrying member has a cut off portion, the fingers in said cut-off portion are cut off, and said selected wires impact through said cut-off portion said print receiving member in a dot-matrix printing mode.

5. A serial impact printer as claimed in claim 1, further comprising means for adjusting the distance between said print receiving member and said wires.

6. A serial impact printer as claimed in claim 5, wherein said distance adjusting means includes means for moving the position at which said print receiving member is set.

7. A serial impact printer as claimed in claim 5, wherein said distance adjusting means includes means for moving said wires.

8. A serial impact printer as claimed in claim 1, wherein said actuating means includes means responsive to the character to be printed in a formed-character printing mode for selectively actuating said wires.

9. A serial impact printer as claimed in claim 1 wherein said means for actuating said plurality of wires comprises an electromagnet, an arm contacting an end of one of said plurality of wires, said arm being pulled towards said print receiving member by said electromagnet when said electromagnet is actuated, and first and second springs for biasing said wire and said arm away from said print receiving member.

* * * * *